United States Patent [19]

Grindley

[11] Patent Number: 4,769,045

[45] Date of Patent: Sep. 6, 1988

[54] METHOD FOR THE DESULFURIZATION OF HOT PRODUCT GASES FROM COAL GASIFIER

[75] Inventor: Thomas Grindley, Morgantown, W. Va.

[73] Assignee: The United States Department of Energy, Washington, D.C.

[21] Appl. No.: 144,683

[22] Filed: Jan. 13, 1988

Related U.S. Application Data

[63] Continuation of Ser. No. 850,301, Apr. 10, 1986, abandoned.

[51] Int. Cl.[4] ..... C10J 3/16; C10K 1/32

[52] U.S. Cl. ..... 48/202; 48/206; 48/210; 252/373; 423/230; 423/231

[58] Field of Search ..... 48/197 R, 202, 206, 48/210, 203; 252/373; 423/230, 231

[56] References Cited

U.S. PATENT DOCUMENTS

| | | | |
|---|---|---|---|
| 292,341 | 1/1884 | McDougall | 423/231 |
| 3,971,637 | 7/1976 | Matthews | 48/202 |
| 4,082,519 | 4/1978 | Steiner | 48/202 |
| 4,089,809 | 5/1978 | Farrior, Jr. . | |
| 4,092,128 | 5/1978 | Hanis et al. | 48/197 R |
| 4,233,275 | 11/1980 | Kimura et al. | 48/210 |
| 4,235,605 | 11/1980 | Kim | 48/202 |
| 4,302,218 | 11/1981 | Friedman | 48/197 R |
| 4,375,362 | 3/1983 | Moss | 48/197 R |
| 4,599,160 | 7/1986 | Gerhold | 423/230 |
| 4,613,344 | 9/1986 | Henrich et al. | 48/197 R |

FOREIGN PATENT DOCUMENTS

| | | | |
|---|---|---|---|
| 928461 | 6/1963 | United Kingdom | 423/231 |

*Primary Examiner*—Peter Kratz

*Attorney, Agent, or Firm*—Earl L. Larcher; Stephen D. Hamel; Judson R. Hightower

[57] ABSTRACT

The gasification of sulfur-bearing coal produces a synthesis gas which contains a considerable concentration of sulfur compounds especially hydrogen sulfide that renders the synthesis gas environmentally unacceptable unless the concentration of the sulfur compounds is significantly reduced. To provide for such a reduction in the sulfur compounds a calcium compound is added to the gasifier with the coal to provide some sulfur absorption. The synthesis gas from the gasifier contains sulfur compounds and is passed through an external bed of a regenerable solid absorbent, preferably zinc ferrite, for essentially completed desulfurizing the hot synthesis gas. This absorbent is, in turn, periodically or continuously regenerated by passing a mixture of steam and air or oxygen through the bed for converting absorbed hydrogen sulfide to sulfur dioxide. The resulting tail gas containing sulfur dioxide and steam is injected into the gasifier where the sulfur dioxide is converted by the calcium compound into a stable form of sulfur such as calcium sulfate.

6 Claims, 1 Drawing Sheet

METHOD FOR THE DESULFURIZATION OF HOT PRODUCT GASES FROM COAL GASIFIER

This is a continuation of application Ser. No. 850,301, filed Apr. 10, 1986, now abandoned.

BACKGROUND OF THE INVENTION

The present invention relates generally to desulfurization of hot coal-derived gases, and more particularly to a method wherein a solid sorbent of zinc ferrite is regenerated with a stream of oxygen-containing gas and steam and with the resulting regeneration tail gas being conveyed into the gasifier for reacting with a calcium compound therein to form environmentally stable calcium-sulfur compounds.

The production of volatile combustion gases by the gasification of coal is becoming of increasing importance as a viable alternative energy source. One of the primary problems encountered during the gasification of coal is the generation of environment polluting sulfur compounds such as hydrogen sulfide and carbon disulfide from the sulfur in the coal.

Efforts to reduce the concentration of deleterious sulfur compounds in the coal-derived gases have been generally successful. One of the sulfur-reducing practices used is to introduce a calcium compound such as lime, limestone or dolomite into the gasifier along with the coal to capture a sufficient percentage of gaseous sulfur produced during the coal-gasification process to reduce the concentration of hydrogen sulfide in the stream of coal-derived gases between 50 and 90%. In such gasification processes the calcium-to-sulfur ratio is about 1.0 to 5.0 for the primary reduction of the concentration of hydrogen sulfide in the product gases. If desired, residual hydrogen sulfide in the product gases can be removed by suitable condensation and scrubbing techniques with the resulting product gases being essentially sulfur free and environmentally acceptable.

One of the problems attendant with known sulfur-capturing processes such as described above is that the scrubbing systems utilized for removing essentially all the sulfur from the product gases require extensive cooling of the coal-derived gases so as to reduce the desirability of the process for use in systems where the sensible heat in the product gases can be utilized to increase the efficiency of the system. Further, the use of condensing and scrubbing systems often provide a sulfur-containing product which is in itself difficult to dispose of due to environmentally pollution problems.

More recently developed mechanisms for removing hydrogen sulfide and other sulfur compounds from the coal-derived gases, without the cooling associated with the described scrubbing techniques, are the use of solid sorbents such as iron oxide, zinc ferrite or a combination thereof. Zinc ferrite has been found to be a particularly effective sorbent in that it can scavenge virtually all of the hydrogen sulfide in the product gases in contact therewith so as to provide product gases with less than about 10 ppm sulfur and be environmentally acceptable. A shortcoming in utilizing zinc ferrite, iron oxide or combinations thereof is that the saturated sorbents may be regenerated by contacting the hydrogen sulfide-containing absorbent with a stream of steam and oxygen or an oxygen-bearing gas such as air for converting the hydrogen sulfide to sulfur dioxide, but the sulfur dioxide must, in turn, be disposed of.

Gasification systems such as fixed bed, fluidized bed, or moving bed types including pressurized versions are usually configured to have an upper gasification or reducing zone and a lower combustion or oxidation zone. In these gasification systems sulfur capture occurs primarily in the lowermost portion of the reducing zone and the underlying combustion zone. It has been found that in such systems, at temperatures below about 1250° F., which are often present in the upper portion of the reducing zone, that equilibrium sulfur captured by calcium compounds or solid absorbent in particulate form varies from 1 to 50 percent, which is not sufficient to meet environmental requirements. Thus, in such coal gasification systems the sulfur content in the product gases even when the gasifier contains sulfur-capturing materials such as calcium compounds or solid absorbents is often above the level considered to be environmentally acceptable. Thus, the product gases must generally be further processed through the scrubbing and condensing systems or beds of solid absorbent downstream of the gasifier, and as pointed out above, the utilization of such gas clean-up systems downstream of the gasifier have some drawbacks which detract from their desirability for sulfur removal.

SUMMARY OF THE INVENTION

Accordingly, it is a primary aim of the present invention to provide a coal-gasification system wherein the gasifier is provided with a feed mixture of a calcium compound and coal for producing a coal-derived gaseous mixture in which the sulfur content thereof is substantially reduced by the presence of the calcium compound in the gasifier. These hot coal-derived gases discharged from the gasifier which still contain sulfur compounds primarily in the form of hydrogen sulfide, are passed through a bed of solid sorbent preferably zinc ferrite, where virtually all the hydrogen sulfide in the gaseous mixture is absorbed to provide essentially sulfur-free product gases at a relatively high temperature. The hydrogen sulfide bearing sorbent in the bed is periodically or continuously regenerated by being contacted with a stream of air and steam to provide exothermic reaction for converting the hydrogen sulfide to sulfur dioxide which is discharged from the sorbent bed as tail gas. The tail gas formed primarily of steam and sulfur dioxide is then conveyed into the combustion zone of the gasifier where the sulfur dioxide reacts with the calcium compounds in the gasifier ash to form calcium sulfate. Any unreacted sulfur dioxide passing through the ash enters the reducing zone of the gasifier where the sulfur dioxide is converted to calcium sulfide and is then subsequently oxidized to a calcium sulfate as a calcium sulfide passes back down through the combustion zone. With the sulfur dioxide converted to solid calcium compounds consisting essentially of calcium sulfate, the ash containing the calcium sulfate may be easily disposed of without deleteriously harming the environment. Normally, about two percent of other calcium compounds such as calcium sulfide and calcium sulfite are environmentally acceptable in the ash product.

The present invention provides a significant advantage over previous coal-gasification clean-up systems in that all waste sulfur streams are processed in a way which provides a stream of hot coal-derived gases particularly suitable for use in a gas turbine arrangement coupled to a coal gasifier. An important feature of the present invention is that sulfur in the tail gas from the regeneration of the solid sorbent is recycled to a gasifier containing calcium sorbents wherein the sulfur is converted to a stable sulfur compound which is environmentally acceptable.

Other and further objects of the invention will be obvious upon an understanding of the illustrative embodiments and method about to be described or will be indicated in the appended claims, and various advantages not referred to herein will occur to one skilled in the art upon employment of the invention in practice.

Preferred embodiments of the invention have been chosen for the purpose of illustration and description. The preferred embodiments illustrated are not intended to be exhaustive or to limit the invention to the precise forms disclosed. They are chosen and described in order to best explain the principles of the invention and their application in practical use to thereby enable others skilled in the art to best utilize the invention in various embodiments and modifications as are best adapted to the particular use contempleted.

DETAILED DESCRIPTION OF THE INVENTION

As generally described above, the present invention is directed to a method for removing sulfur compounds from synthesis gas derived from the gasification of sulfur-bearing coal in a gasifier having a gasifying or reducing zone and a combustion or oxidation zone. The steps of the method comprise introducing particulates of coal and a calcium compound into the gasifier and heating the coal particulates in the gasifier to a temperature adequate to form a gaseous product. During gasification some of the sulfur released from the coal is captured by the calcium compound while the remaining sulfur is converted to a gaseous sulfur compound, primarily hydrogen sulfide, which is admixed with the gaseous product. This sulfur compound-containing gaseous product while still hot is conveyed from the gasifier through a sorbent bed containing a solid particulate absorbent, preferably zinc ferrite, for scavenging or absorbing essentially all the hydrogen sulfide and other sulfur compounds from the gaseous product. The particulate zinc ferrite containing absorbed hydrogen sulfide is regenerated by contacting the zinc ferrite with a stream of air or oxygen and steam which exothermally reacts with the hydrogen sulfide to convert it to sulfur dioxide which is driven from the zinc ferrite as a tail gas. This tail gas which also contains steam, is conveyed into the lower end of the gasifier for reacting with the calcium compound in the ash for forming solid calcium-sulfur compounds. Any residual sulfur dioxide is converted to calcium sulfide in the reducing zone and then oxidized to calcium sulfate in the oxidizing zone. These calcium-sulfur compounds which consist primarily of calcium sulfate are removed from the gasifier along with the ash for disposal. The steam in the tail gas is used in the gasification process and provides a portion of the steam normally used in the gasification process so as to increase the efficiency and cost-effectiveness of the system.

Figure 1:
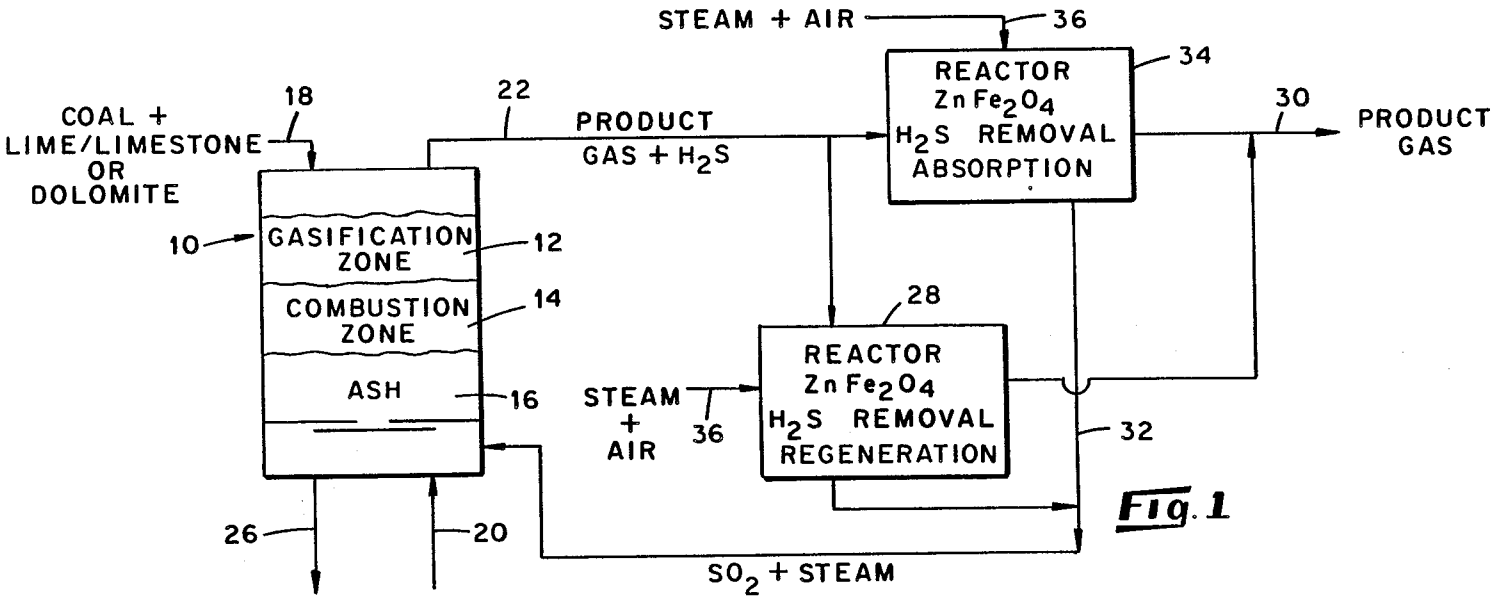
FIG. 1 is a schematic view showing one embodiment of the coalgasification system of the present invention in which the sulfurbearing coal-derived gases are passed through a sulfur scavenging zone containing a regenerable solid sorbent and in which the tail gas containing sulfur dioxide from the regeneration is conveyed into the gasifier for conversion into a stable calcium-sulfur compound.
Figure 2:
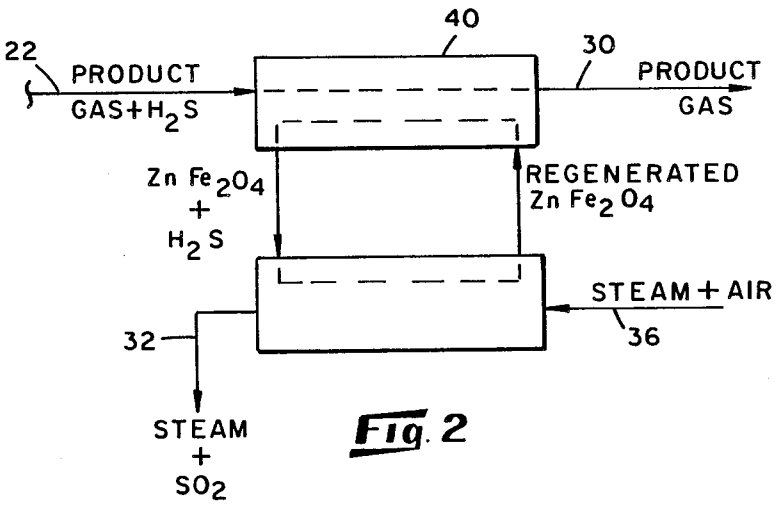
FIG. 2 is another embodiment of the present invention employing the same principles of the FIG. 1 embodiment except that the solid sorbent is contained in a recirculating bed whereby the sorbent can be continuously regenerated to provide fresh absorbent for effective sulfur capture.

As shown in FIGS. 1 and 2 of the drawings, the gasifier 10, which may be of any suitable type such as a moving bed, fixed bed or fluidized bed and which may operate at a pressure in the range of about atmospheric to about 300 psi, is shown divided into separate internal zones. The uppermost zone in the gasifier is a gasification or reducing zone 12 overlying a combustion or oxidation zone 14 which, in turn, overlies an ash zone 16. The operating temperatures in the gasifier may range from about 2,300° F. in the combustion or oxidation zone 14 to about 1,000° F. at the uppermost part of the gasification or reducing zone 12. The temperature in the ash zone 16 is usually about 500° F. Typically, an admixture of coal particulates in the size range of about 0.75 to 1.25 inches and a particulate calcium compound such as lime, limestone, dolomite or mixtures thereof in the size range of about 0.25 to 0.75 inch and in a concentration sufficient to provide a calcium-to-sulfur ratio of about 1 to 3:1 is introduced into the top of the gasifier 10 through conduit 18 for effecting the gasification of the coal. The coal may be bituminous, sub-bituminous, lignite, coke or other common carbonaceous forms of coal useful in gasification processes. The coal is gasified in the gasification zone 12 by the heat exothermally supplied in the combustion zone 14 where air and steam are added through conduit 20 at the bottom of the gasifier to support the exothermic reaction. The product gases resulting from the gasification contain hydrogen, methane, carbon dioxide, carbon monoxide, nitrogen, and hydrogen sulfide as the principal gases exit from the gasifier through conduit 22 disposed at the top thereof. The calcium compound-containing sulfur and the depleted coal (ash) are discharged from the gasifier 10 through the ash zone 16 and exit conduit 26 at the base of the gasifier.

In a typical gasification operation where the sulfur content of the coal is in the range of about 1 to 5 percent, the product gas stream exiting conduit 22 will contain about 1,000 to 5,000 ppm sulfur in the form of hydrogen sulfide and carbon disulfide after about 50 to 90 percent of the sulfur is captured during gasification by the calcium compound in the gasifier. The sulfur content of the product gases must be reduced to a level of about 2000 to 1,000 ppm to be acceptable for direct discharge into the environment, but must be reduced to about 10 ppm for use many advance power systems such as gas turbines and fuel cells. The use of the calcium compound in the gasifier causes a significant reduction of the available sulfur since calcium compounds are excellent as scavengers of hydrogen sulfide under certain conditions. But, as briefly pointed out above, at temperatures less than about 1,250° F. which are present in a considerable part of the uppermost portion of the gasification zone, the sulfur capture by the calcium compounds is very minimal.

In accordance with the present invention the hot synthesis gas or product gas discharge from the gasifier 10 through conduit 22 is directed through a solid sorbent reactor generally shown at 28. In this reactor 28 there is a bed of particulate solid sorbent which is used to capture or absorb virtually all the hydrogen sulfide and other sulfide compounds from the product gases passed therethrough. This solid sorbent is preferably a bed or particulate zinc ferrite which has been shown to be capable of removing sulfur compounds especially hydrogen sulfide from hot coal-derived gases to provide the gases with a low sulfur content in the order of about 10 ppm. Further, the zinc ferrite can be readily regenerated and reused repeatedly without deleterious degradation. Satisfactory results can also be achieved by using iron oxide or iron oxide and zinc ferrite mixtures as solid sorbent since these sorbents also provide for highly effective sulfur absorption and can be regenerated. Other molecular weight sulfur compounds such as COS and $CS_2$ represented in the product gases in concentrations of about 10 to 500 ppm are also removed by the sorbent in the reactor 28 to levels below 10 ppm. The product gas exiting the reactor 28 through conduit 30 is at temperature in the range of about 1,000° to 1,200° F. and can be used in a combustion process as a fuel with the sensible heat of fuel being used to increase the efficiency of the combustion process.

The zinc ferrite is regenerated for reuse by contacting the zinc ferrite with a mixture of steam and air at a ratio of about 5 to 10:1 with the steam at a temperature of about 1,000° F. During this regeneration an exothermic reaction occurs in the absorbent bed which reaches a temperature of about 1,300° F. to 1,500° F. which passes through the absorbent bed. During this reaction the hydrogen sulfide in the absorbent is converted to sulfur dioxide which emerges from the absorbent bed as a tail gas formed primarily of steam, nitrogen and sulfur dioxide. Some residual sulfate may remain in the bed and can be removed by following the stream/air oxidative regeneration step with a short reductive regeneration step in which a small quantity of hot desulfurized gas is recycled through the zinc ferrite. The tail gas from the regeneration of the absorbent contains sulfur dioxide in a concentration of about 2 to 4 percent and is at a temperature in the range of about 1,000° to 1,500° F. when the absorbent is zinc ferrite. In accordance with the present invention the tail gas is conveyed through conduit 32 into the gasifier 10 through the lower end thereof with the steam in the tail gas facilitating the gasification reaction while essentially all of the sulfur dioxide is absorbed in the ash zone 16 in the gasifier ash containing the calcium compounds. Any residual sulfur dioxide passes upward into the gasification zone 12 and reacts with the calcium compound therein to form calcium sulfide which is subsequently oxidized to calcium sulfate in the combustion zone 14 and passed into the ash zone 16. Thus, the present invention is capable of removing sulfur compounds from the coal-derived gases to exceptionally low levels by employing a solid sorbent and then removing the absorbed sulfur compounds and converting them to a calcium-sulfur compound which is environmentally acceptable and therefor readily disposable.

The regeneration of the absorbent in the reactor 28 can be achieved periodically or continuously. As shown in the FIG. 1 embodiment a plurality of solid absorbent reactors such as 28 and 34 are shown coupled in a parallel so that as the hot producer gas is passing through one reactor such as 28 the solid absorbent bed in the other reactor 34 can be in a regeneration cycle provided by passing a stream of steam and air through conduit 36. Only two reactors are shown but there can be any desired number. With such a system an essentially continuous flow of tail gas can be fed into the gasifier through conduit 32 for sulfur capture while the flow of hot product gases can be directed through the various reactors in an uninterrupted manner to provide a continuously stream of essentially sulfur-free hot gases for any desired use such as fuel in a combustion system for a gas turbine.

Alternatively, the solid sorbent reactor may be in the form of a circulating bed as generally shown in FIG. 2 where the reactor 40 contains a circulating bed of absorbent which is continuously placed in the path of the product gases to absorb the sulfur therefrom while previously exposed absorbent is continuously subjected to a regeneration cycle by passing steam and air through conduit 36.

It will be seen that the present invention provides for the removal of sulfur compounds from synthesis gas produced by using a solid regenerable solid sorbent, preferably zinc ferrite, and wherein the sulfur compounds formed during the regeneration of the sorbent are introduced into the gasifier for reaction with an expendable calcium compound for providing a stable form of sulfur which can be readily disposed of without creating environmental problems.

I claim:

1. A method for removing sulfur compounds from coal-derived gases produced from the gasification of coal containing sulfur in a gasifier having a gasification zone, a combustion zone and an ash zone, comprising the steps of introducing a mixture of particulate coal and a calcium compound into the gasifier, heating the coal particulates in the gasifier to a temperature adequate to form a coal-derived gaseous mixture containing sulfur compounds including hydrogen sulfide, conveying the gaseous mixture through a bed containing particulate absorbent from zinc ferrite, iron oxide, or combinations thereof for absorbing sulfur compounds including the hydrogen sulfide from the gaseous mixture, thereafter contact the particulate absorbent containing absorbed hydrogen sulfide with a stream of air or oxygen and steam for regenerating the absorbent by converting the hydrogen sulfide to sulfur dioxide, conveying a stream containing steam and the sulfur dioxide resulting from the regeneration of absorbent into the gasifier for contact and reaction with said calcium compound within the gasifier to form therewith a solid sulfur-calcium compound, and removing the sulfur-calcium compound from said gasifier.

2. A method for removing sulfur compounds from coal-derived gases as claimed in claim 1, wherein the gaseous mixture conveyed through said bed of particulate absorbent is at a temperature in the range of about 1,000° to 1,200° F. entering said bed of particulate absorbent and in the range of about 1,000° to 1,500° F. exiting said bed of particulate absorbent.

3. A method for removing sulfur compounds from coal-derived gases as claimed in claim 1, wherein the bed of particulate absorbent is periodically contacted with the stream of air or oxygen and steam for regenerating the absorbent.

4. A method for removing sulfur compounds from coal-derived gases as claimed in claim 3, including the step of coupling in parallel a plurality of beds of particulate absorbent to said gasifier, wherein the step of conveying the gaseous mixture through a bed of particulate absorbent is provided at only one of said plurality of beds at any given time.

5. A method for removing sulfur compounds from coal-derived gases as claimed in claim 4, wherein the step of contacting the bed of particulate absorbent with the stream of air or oxygen and steam is provided at another one of said plurality of beds of particulate absorbent distinct from the bed of solid absorbent through which the gaseous mixture is being conveyed.

6. A method for removing sulfur compounds from coal-derived gases as claimed in claim 1, wherein said bed of particulate absorbent is a circulating bed with different portions thereof being subjected to the gaseous mixture containing the sulfur compounds and the stream of air or oxygen and steam for concurrently absorbing the sulfur compounds in the particulate absorbent and regenerating the particulate absorbent.

* * * * *